United States Patent [19]

Morse et al.

[11] Patent Number: 4,802,609

[45] Date of Patent: Feb. 7, 1989

[54] SANITARY FOODSTUFF DISPENSER

[76] Inventors: Hugh B. Morse, 680 Wildwood Dr., Watsonville, Calif. 95076; John V. Ciolino, 13558 Paseo Terrano St., Salinas, Calif. 93908

[21] Appl. No.: 941,732

[22] Filed: Dec. 15, 1986

[51] Int. Cl.[4] ..... B67D 5/38

[52] U.S. Cl. ..... 222/158; 222/185; 222/233; 222/413; 222/424.5; 222/469; 222/517; 222/531; 222/533; 222/556

[58] Field of Search ..... 222/233, 413, 158, 469, 222/278, 517, 183, 185, 44, 556, 528, 449, 452, 424.5, 445, 446, 425, 531, 533, 364, 362, 71, 476, 412, 414; 414/326, 310, 319–321; 198/550.1, 550.01, 532, 676, 664

[56] References Cited

U.S. PATENT DOCUMENTS

| | | | |
|---|---|---|---|
| 823,262 | 6/1906 | Collins | 198/664 |
| 1,529,379 | 3/1925 | Thompson | 222/413 |
| 2,447,409 | 8/1948 | Gulow | 222/531 X |
| 2,532,318 | 12/1950 | Mackey et al. | 198/676 X |
| 2,593,803 | 4/1952 | Schofield | 222/413 X |
| 2,617,273 | 11/1952 | Findlay | 198/676 X |
| 3,241,728 | 3/1966 | Murphy | 222/158 X |
| 3,358,886 | 12/1967 | Provenza | 222/158 |
| 3,637,112 | 1/1972 | Christy | 222/442 X |
| 3,705,644 | 12/1972 | Kawchitch | 198/644 |
| 4,029,237 | 6/1977 | Miconi | 222/412 X |
| 4,085,866 | 4/1978 | Fekl | 222/158 |
| 4,364,667 | 12/1982 | Reiner | 198/664 X |
| 4,712,717 | 12/1987 | Egerdahl | 222/413 X |
| 4,718,578 | 1/1988 | Radek et al. | 222/108 |

OTHER PUBLICATIONS

I.B.M. Technical Disclosure Bulletin, vol. 19, No. 6.

*Primary Examiner*—Kevin P. Shaver
*Assistant Examiner*—Gregory L. Huson
*Attorney, Agent, or Firm*—Phillips, Moore, Lempio & Finley

[57] ABSTRACT

A dispenser for dispensing solid snack foods and the like comprises a closed container defining a chamber adapted to be at least partially filled with a snack food. A measuring cup is mounted on the container for receiving a measured quantity of the snack food. A dispensing tray is pivotally mounted on the measuring cup to normally close an open bottom thereof and is moveable to an open position for discharging the measured quantity of foodstuff. An elongated screw is mounted in the container, between the chamber and measuring cup, and is adapted to be manually turned to convey the measured quantity of foodstuff into the measuring cup.

27 Claims, 4 Drawing Sheets

FIGURE_8.
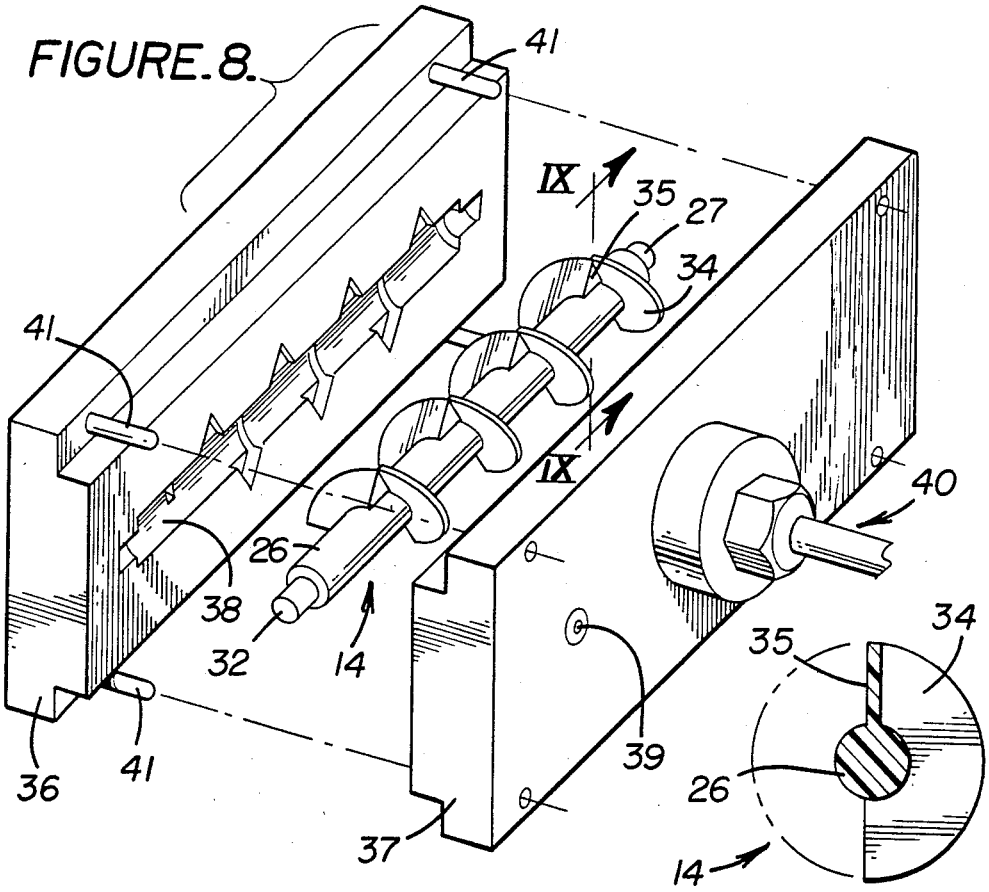
FIGURE_9.
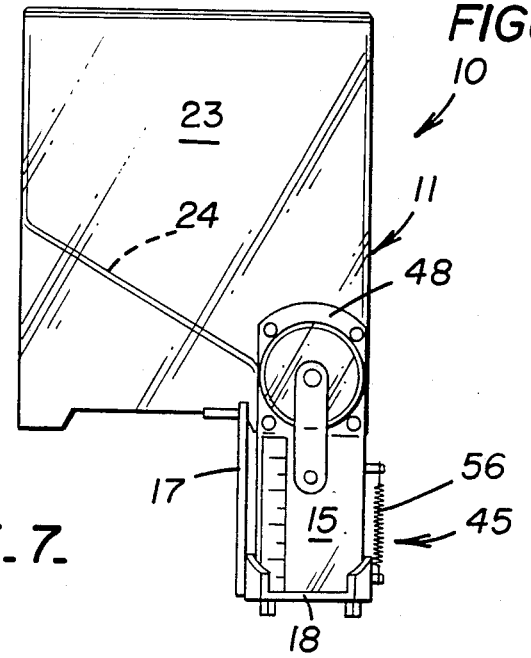
FIGURE_7.

SANITARY FOODSTUFF DISPENSER

TECHNICAL FIELD

This invention relates to a dispenser for foodstuffs and more particularly to a dispenser for snack foods having a rotary screw conveyor.

BACKGROUND ART

The bulk handling of snack foods in health and grocery stores is normally accomplished by use of open top containers and scoops. In particular, a customer will normally scoop out the desired quantity of a snack food and place it in a plastic or paper bag for weighing and price determination purposes. Snack foods of this type may include raisins, other types of dried fruit, malt balls, cookies, mixed nuts, various candies and the like.

Conventional containers of this type are unsanitary since the snack food is exposed to ambient dirt, dust and vermin, and potential customer contamination. Various dispensing apparatus have been proposed to alleviate the problem of sanitation. For example, U.S. Pat. Nos. 2,920,796 and 4,511,067 each disclose a dispenser that utilizes a paddle-wheel type of conveying member for dispensing measured quantities of foodstuffs. U.S. Pat. No. 2,550,248 discloses a dispenser that includes a reciprocal tray for effecting the dispensing function. U.S. Pat. No. 2,593,803 discloses another type of dispenser wherein a screw conveyor shaft is utilized to dispense finely divided products such as sugar or salt, into a receptacle that is emptied by tipping the dispenser.

Dispensing apparatus of the above type are relatively complex in construction and operation and may give rise to clogging and related problems. Each dispenser is normally constructed to dispense a single type of foodstuff product and is not particularly adapted for dispensing various types of products having particle sizes ranging from sugar to dried fruit. Further, many such dispensers fail to provide the customer with continuous visual inspection of the dispensed product and accurate measurement of the quantity of product being dispensed.

SUMMARY OF THE INVENTION

This invention overcomes the above, briefly described problems by providing a sanitary foodstuff dispenser that is non-complex, easy to operate, adapted to accurately dispense foodstuffs having a wide range of particle or product size, and that is clog-free. In addition, the dispenser is preferably transparent to permit the consumer to visually note the quantity of product being dispensed.

The sanitary foodstuff dispenser of this invention comprises a closed container defining a chamber adapted to be filled with a preselected quantity of dry foodstuff. A closed measuring cup is mounted on the container for receiving a measured quantity of the foodstuff. An elongated screw conveyor is rotatably mounted in the container to selectively fill the cup with the measured quantity of foodstuff upon manual turning thereof. Dispensing means are provided for dispensing the measured quantity of foodstuff from the measuring cup.

BRIEF DESCRIPTION OF THE DRAWINGS

Other objects and advantages of this invention will become apparent from the following description and accompanying drawings wherein:

FIG. 7 is an end elevational view of the dispenser, showing a measuring cup and dispensing assembly mounted on an end of the dispenser opposite to that shown in FIG. 3;

FIG. 8 schematically illustrates a mold for making a screw conveyor employed in the dispenser; and FIG. 9 is a cross-sectional view through the screw conveyor, taken in the direction of IX—IX in FIG. 8.

BEST MODE OF CARRYING OUT THE INVENTION

General Description

Figure 1:
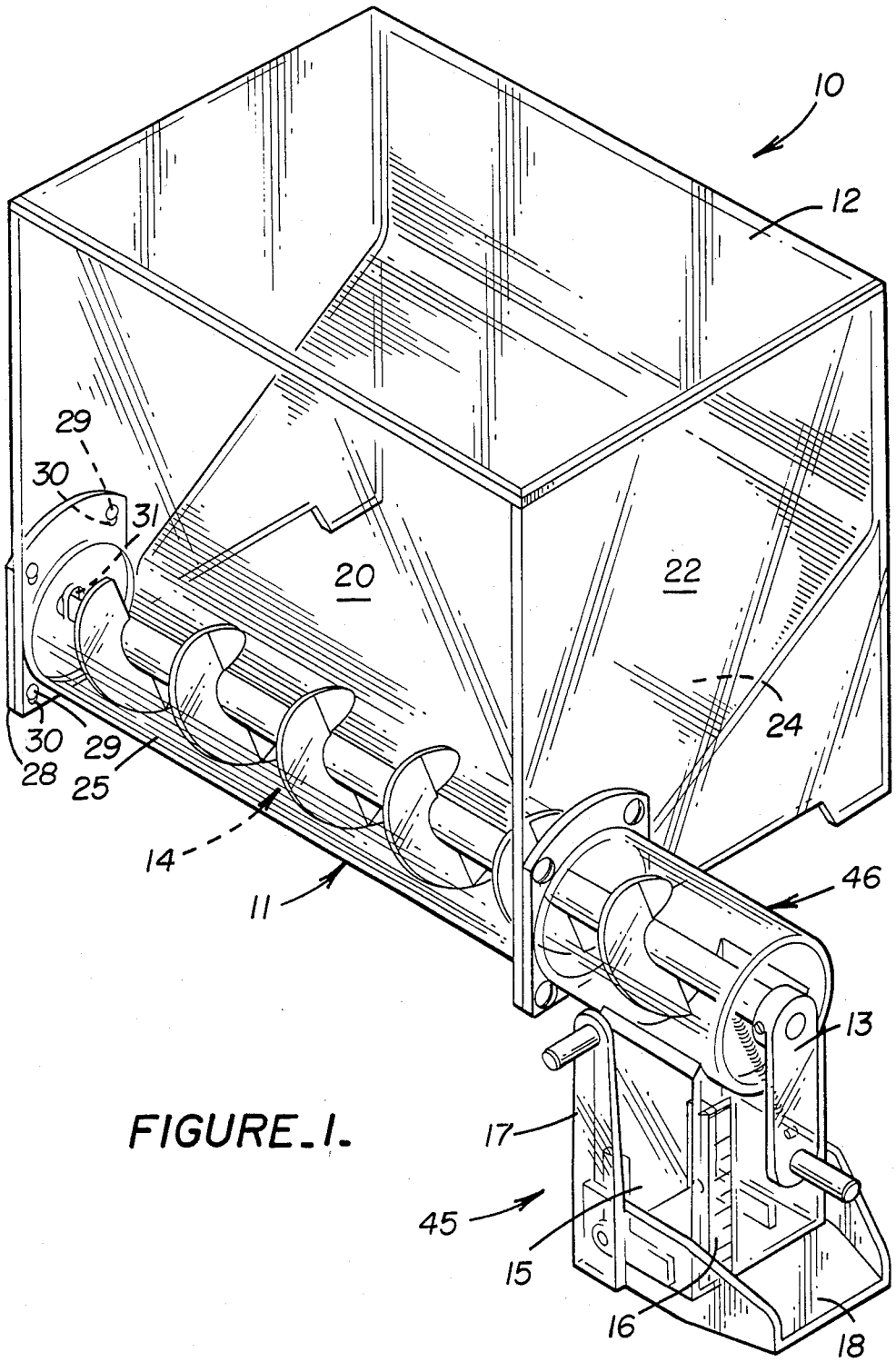
FIG. 1 is a frontal isometric view illustrating a sanitary foodstuff dispenser embodying this invention.

FIG. 1 illustrates a transparent sanitary foodstuff dispenser 10 comprising a container 11 having a removable cover 12 mounted thereon. The container defines a closed chamber therein adapted to be at least partially filled with a preselected quantity of dry foodstuff. The foodstuff may comprise any of the standard snack foods sold in health and grocery stores, such as nuts, dried fruit, candies, etc. The dispenser is equally adapted to dispense finer products, such as sugar, flour, coffee and tea.

In use, a customer need only rotate a crank 13 generally clockwise in FIG. 1 a selected number of full or partial turns to rotate a screw conveyor 14 to charge a measuring cup 15 with a measured quantity of the product. Measuring indicia, shown in the form of a marked and graduated tape 16, will visually indicate such measured quantity to the consumer. The customer will then rotate a hand lever 17 generally clockwise in FIG. 1 to pivot a chute 18, normally covering an open bottom of cup 15, to its open position 18', illustrated by phantom lines in FIG. 2, to dispense the product from the cup and into a bag.

Detailed Description

Figures 2, 2A, 3:
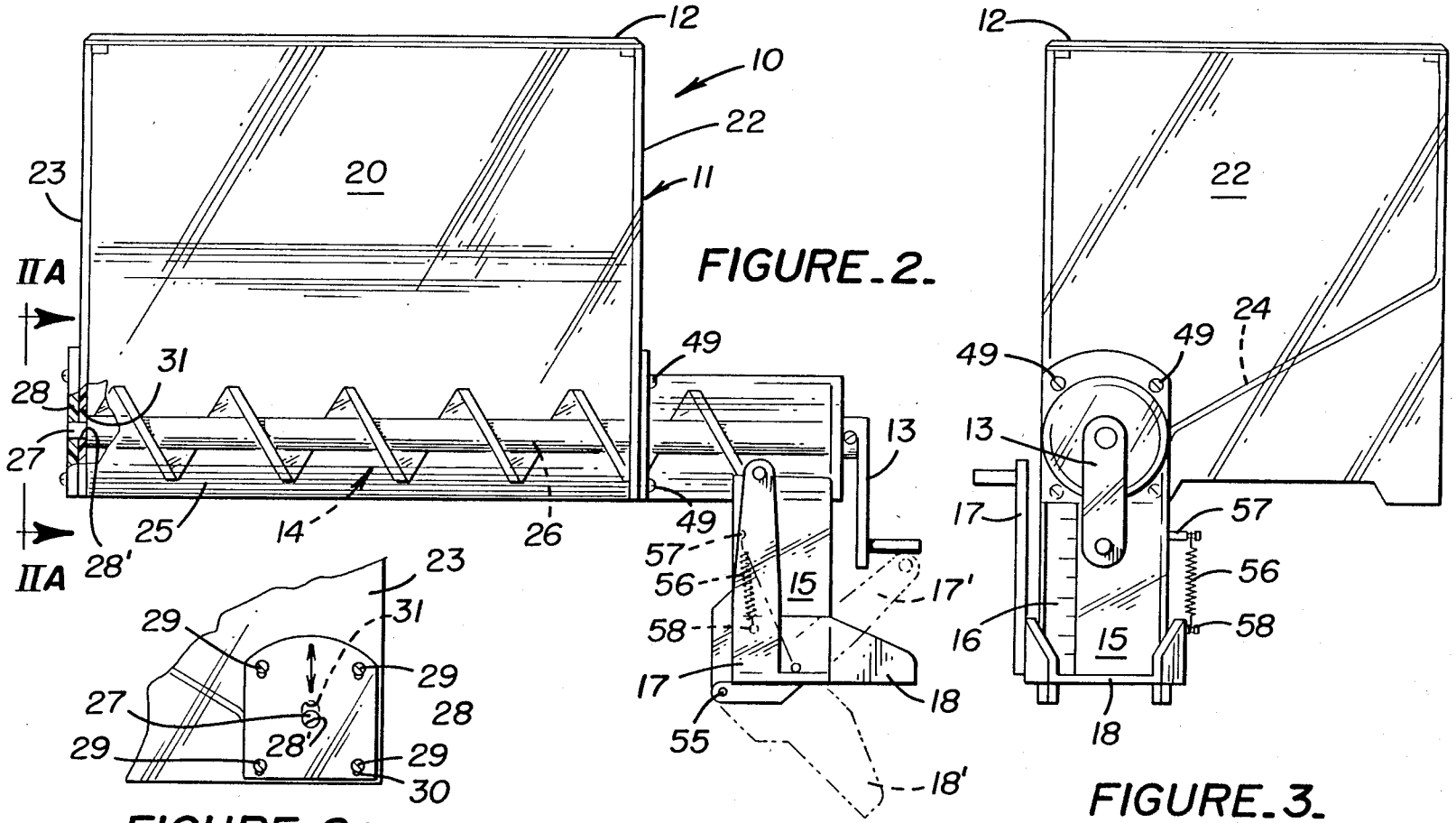
FIG. 2 is a front elevational view of the dispenser.
FIG. 2A is a view taken in the direction of arrows 11A—11A in FIG. 2.
FIG. 3 is an end elevational view of the dispenser.

Referring to FIGS. 1–3, container 11 further comprises upstanding front, back and side walls 20–23, respectively, and a bottom wall 24. The container and other major components of the dispenser are preferably composed of a standard transparent and high impact plastic material. As shown in FIG. 3, bottom wall 24 slopes downwardly from back wall 21 towards front wall 20 and terminates forwardly at an arcuate portion 25 underlying screw conveyor 14. The screw conveyor is thus continuously exposed to the product contained in the chamber, defined by the walls of the container. The clearance between bottom wall portion 25 and the screw conveyor is pre-designed to accommodate the size of the particular product being transported.

As shown in FIGS. 2 and 2A, screw conveyor 14 comprises a shaft 26 having a reduced shaft section 27 rotatably mounted in an accommodating hole 28' formed through a plate 28. Each corner of the plate is attached to side wall 23 by a screw 29 with the shank of the screw extending through a vertically disposed slot 30, formed through the plate. Plate 28 and thus shaft 26 are permitted limited vertical movement relative to side wall 23 with a vertically disposed slot 31 being formed through the side wall to accommodate such movement of the shaft.

Figure 5:
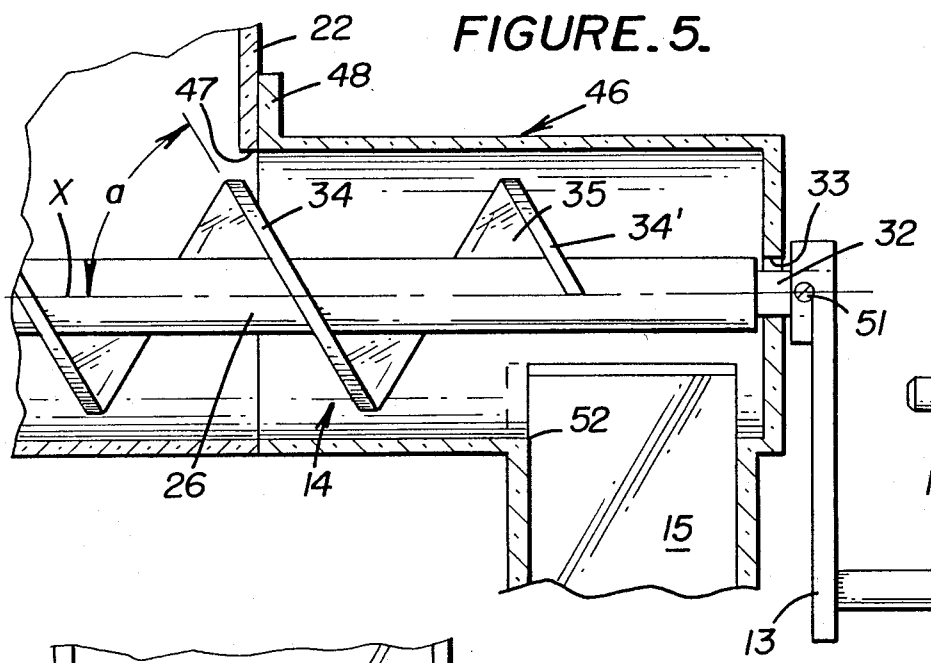
FIG. 5 is a sectional view, taken in the direction of arrows V—V in FIG. 4.

As shown in FIG. 5, an opposite reduced end 32 of the shaft is rotatably mounted in a slightly oversided mounting hole 33 to accommodate the aforementioned vertical movements of the shaft. This freedom of movement, accorded to the shaft, aids in preventing any binding of foodstuffs between bottom wall portion 25 of the container and the screw conveyor. For example, should a dried apricot or the like become wedged between the screw conveyor and bottom wall portion 25, continual advancement of the screw conveyor rightwardly in FIG. 2 and simultaneous limited vertical reciprocation of the shaft will function to dislodge the dried apricot from its binding position.

Referring to FIGS. 5, 8 and 9, screw conveyor 14 further comprises a plurality of flat, semi-circular blades 34 secured in longitudinally spaced relationship on shaft 26. As shown in FIG. 5, each blade is disposed at an acute angle "a", relative to a longitudinal rotational axis X of shaft 26. Such angle is preferably selected from the approximate range of from 45° to 75° and largely depends on the particular type of product being dispensed. The illustrated angle closely approximates 60°.

A triangularly shaped web 35 interconnects the opposed edges of each pair of adjacent blades together on diametrically opposite sides of shaft 26. As shown in FIGS. 8 and 9, the webs on each side of shaft 26 are thus disposed in longitudinal alignment with each other and are further aligned and in the same radial plane containing axis X.

The split involute configuration of screw conveyor 14 provides that the product will be conveyed gently and without damage or undue binding. Another advantage of this type of screw conveyor is that it can be injection molded in a single operation in contrast to a conventional full involute screw conveyor that cannot be molded in this manner. FIG. 8 schematically illustrates a typical two-part mold comprising a pair of mold parts 36 and 37 each having a die cavity 38 formed on a frontal side thereof (one shown) with each die cavity defining a respective one-half of the screw conveyor.

The screw conveyor is formed from a suitable thermo-plastic or thermo-setting resin molding powder (thermo-plastics are preferred since they are fully polymerized before processing and, during the injection molding process, they undergo a physical change only). The powder is injected by a nozzle (not shown) adapted to engage within an inlet 39 to a sprue communicating with the die cavities in a conventional manner. A ram 40 is adapted to reciprocate mold part 37 into and out of engagement with mold part 36. A plurality of locating pins 41, secured on mold part 36, are adapted to engage within accommodating holes 42, defined in mold part 37, to precisely align the cavities with each other.

Figure 4:
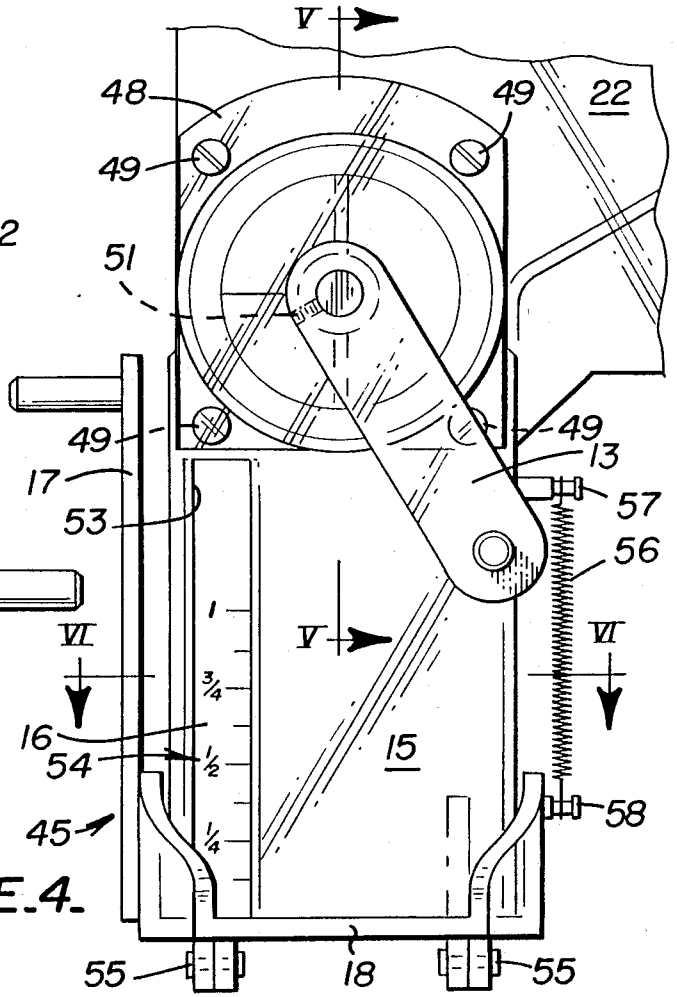
FIG. 4 is an enlarged and partial end elevational view of the dispenser, showing various working components thereof.

Referring to FIGS. 2–5, measuring cup 15 and dispensing chute 17 are incorporated into a modular measuring cup and dispensing assembly 45, preferably secured in offset relationship at a lower frontal corner on side wall 22 of container 11. The assembly includes a tubular shroud 46 that covers the distal end of screw conveyor 14 and the assembly has measuring cup 15 and dispensing chute 18 mounted thereon. As shown in FIG. 5, a circular opening 47 is formed through side wall 22 to accommodate the screw conveyor and a flange 48 of the assembly is detachably secured on the side wall by four screws 49 (FIG. 4). The outer shape of the flange corresponds to that of plate 28 (FIG. 2A) for purposes hereinafter described.

As more clearly shown in FIGS. 4 and 5, hand crank 13 is secured on reduced end 32 of screw conveyor shaft 26 by a set screw 51. It should be noted in FIG. 5 that a shortened blade (e.g., extending circumferentially approximately 45°) extends slightly longitudinally beyond an entrance edge 52 of measuring cup 15 to ensure positive and free flow of the product into the cup, under the influence of gravity. In contrast to thus providing an accurate and smooth flow of the product into the cup, extension of blades 34 to the distal end of shaft 26 might induce bindig of the product thereat and less manual control over arcuate product flow.

Figure 6:
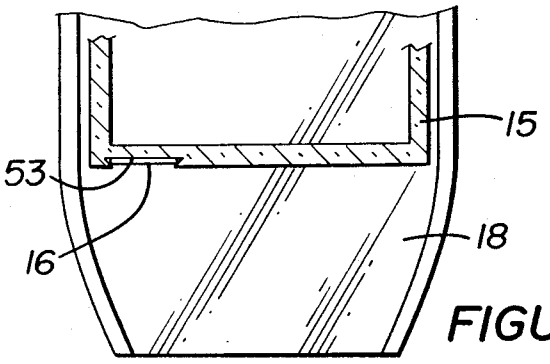
FIG. 6 is a sectional view, taken in the direction of arrows VI—VI in FIG. 4.

As shown in FIGS. 4 and 6, measuring tape 16 is inserted downwardly into a the vertically disposed dovetail slot or groove 53, formed on a frontal side of measuring cup 15. The tape has graduated indicia 54 imprinted thereon to permit the customer to visually note when the desired quantity of product is retained in the transparent measuring cup. The indicia may indicate either volume or weight, depending on the particular food product being dispensed.

Referring to FIGS. 1–4, chute 17 has its rearward end pivotally mounted on cup 15 by a pair of laterally spaced and aligned pins or screws 55. As shown in FIG. 2, hand lever 17 is secured on a frontal side of the tray for pivoting the tray from its solid line closed position 18 covering the open bottom of measuring cup 15 to its phantom line dispensing position 18' in response to the illustrated clockwise pivotal movement of the hand lever from position 17 to position 17'.

A tension coil or retraction spring 56 has its upper end attached to a first pin 57 secured on an upper end of a backside of cup 15 and its lower end attcahed to a second pin 58 secured on a backside of tray 17. As shown in FIG. 2, pin 58 is offset rightwardly, relative to pin 57, whereby movement of tray 18 to its phantom line open or dispensing position 18' will permit the spring to retract when hand lever 17 is released. Thus, the spring will automatically bias and move the tray back to its solid line closed position 18, covering the open bottom of cup 15.

FIG. 7 illustrates a modification of dispenser 10 wherein measuring cup and dispensing assembly 45 are mounted on side wall 23, rather than on side wall 22. Screw conveyor 14 would also be reversed with plate 28 and flange 48 being reversible and sized to accommodate this modification. The only modification to container 11 would be the formation of a circular opening, corresponding to opening 47, through side wall 23 and the provision of tolerance slots 30 in side wall 22 to accommodate reciprocation of screws 29.

It should be noted that the configuration of dispenser 10 and the offset positioning of measuring cup and dispensing assembly 45 thereon, facilitates various stackings and mounting arrangements of a plurality of dispensers on shelves in grocery stores or the like.

We claim:

1. A sanitary foodstuff dispenser for dispensing a measured quantity of solid foodstuff comprising a closed container defining a chamber adapted to be at least partially filled with a preselected quantity of solid foodstuff, said container comprising vertically disposed and flat front, back and side walls, and a single bottom wall including a flat wall portion secured in said container to slope downwardly from an upper end of said back wall towards a lower end of said front wall and terminating at an arcuate wall portion merging with said front wall, a measuring cup means, having an upper end and an open bottom end, mounted on one of the side walls of said container adjacent to said front wall, for receiving said measured quantity of said foodstuff, screw means exposed to the foodstuff in said chamber and extending over and openly communicating with the open upper end of said cup means for selectively filling said cup means with said measured quantity of foodstuff in response to rotation of said screw means, said screw means comprising a shaft having a plurality of flat blades secured in longitudinally spaced and split involute relationship thereon to extend radially therefrom to provide longitudinally spaced surface means on said blades for conveying a wide variety of said solid foodstuff therealong in a clog-free manner, said screw means substantially positioned within and conforming to the arcuate wall portion of said bottom wall and extending vertically above a juncture of the flat and arcuate wall portions of said bottom wall to freely receive foodstuff deposited on said screw means under the influence of gravity from the flat wall portion of said bottom wall,and dispensing means, movably mounted on said cup means, for dispensing said measured quantity of foodstuff from said cup means.

2. The dispenser of claim 1 wherein said measuring cup means comprises a transparent cup member and further comprising vertically disposed indicia means on a side of said cup member for visually indicating the measured quantity of foodstuff in said cup member.

3. The dispenser of claim 2 wherein said cup has a vertically disposed slot defined thereon and wherein said indicia means comprises an imprinted slip removably mounted in said slot.

4. The dispenser of claim 1 wherein said cup means and said dispensing means are incorporated into a modular measuring cup and dispensing assembly secured in offset relationship at a lower frontal corner and on a side wall of said container.

5. The dispenser of claim 4 wherein said assembly further comprises a shroud detachably secured on a side wall of said container and wherein a distal end of said screw means is rotatably mounted in said shroud.

6. The dispenser of claim 1 wherein said cup means comprises a cup secured on said container and defining an open upper end communicating with said screw means and an open bottom end and wherein said dispensing means comprises a tray mounted on said cup for movement from a first position normally closing the open bottom of said cup to a second position opening the open bottom of said cup to dispense said measured quantity of foodstuff therefrom.

7. The dispenser of claim 6 wherein said tray is pivotally mounted on said cup and further comprising spring means for biasing said tray to its first position.

8. The dispenser of claim 7 wherein said dispensing means further comprises a hand lever secured on said cup for pivoting said tray relative thereto.

9. The dispenser of claim 1 wherein each of said blades is disposed at an angle selected from the range of from approximately 45° to 75° relative to a longitudinal and rotational axis of said screw means.

10. The dispenser of claim 9 wherein said blades are equally spaced longitudinally relative to each other.

11. The dispenser of claim 9 wherein at least a majority of said blades extend circumferentially approximately 180° about said shaft and further comprising a generally triangularly shaped web interconnected between opposed edges of each adjacent pair of said blades.

12. The dispenser of claim 9 wherein said shaft and said blades comprise a one-piece molded structure.

13. The dispenser of claim 9 wherein said measuring cup means has an entrance edge positioned adjacent to said screw means for receiving said measured quantity of foodstuff thereover and wherein one of said blades extends slightly longitudinally beyond said entrance edge.

14. The dispenser of claim 9 wherein said shaft has opposite ends thereof rotatably mounted on said container.

15. The dispenser of claim 14 further comprising means for mounting at least one end of said shaft on said container for permitting said shaft and screw means to move vertically relative to said container.

16. A sanitary foodstuff dispenser for dispensing a measured quantity of solid foodstuff comprising a container having upstanding front, back and side walls and a single bottom wall collectively defining a chamber adapted to retain said foodstuff, said bottom wall including a flat wall portion secured in said container to slope downwardly from an upper end of said back wall towards a lower end of said front wall and terminating at an arcuate wall portion merging with said front wall, a screw conveyor positioned forwardly in said chamber adjacent to the juncture of said front and bottom walls and extending in parallel relationship throughout the full length of said front wall, said screw conveyor substantially positioned within and conforming to the arcuate wall portion of said bottom wall and extending vertically above a juncture of the flat and arcuate wall portions of said bottom wall to freely receive foodstuff deposited on said screw conveyor under the influence of gravity from the flat wall portion of said bottom wall, and a modular measuring cup and dispensing assembly mounted in offset relationship on a lower, frontal corner of one of said side walls, adjacent to said front wall, said assembly comprising a measuring cup means for receiving said measured quantity of foodstuff from said screw conveyor, said measuring cup means comprising a cup member defining an open upper end communicating with said screw conveyor and extending downwardly from said screw conveyor to terminate at an open bottom end thereof, and dispensing means for dispensing said measured quantity of foodstuff from said cup means, said dispensing means comprising a tray extending transversely across the open bottom end of said cup member and pivotally mounted thereon for movement from a first position normally closing the open bottom end of said cup member to a second position opening the open bottom end of said cup member and to position said tray at an inclined position relative to said cup member to guide said foodstuff into the open end of a bag placed on an end of said tray.

17. The dispenser of claim 16 wherein said cup member is transparent and further comprising vertically disposed indicia means on a side of said cup member for visually indicating the measured quantity of foodstuff in said cup member.

18. The dispenser of claim 16 further comprising spring means for biasing said tray to its first position.

19. The dispenser of claim 16 wherein said dispensing means further comprises a hand lever secured on said cup member for pivoting said tray relative thereto.

20. The dispenser of claim 16 wherein said measuring cup means has an entrance edge positioned adjacent to said screw conveyor for receiving said measured quantity of foodstuff thereover and wherein one of said blades extends slightly longitudinally beyond said entrance edge.

21. The dispenser of claim 16 wherein said assembly further comprises a shroud detachably secured on a side wall of said container and a distal end of said screw conveyor is rotatably mounted in said shroud, said cup member secured to and extending downwardly from said shroud.

22. The dispenser of claim 16 wherein said screw conveyor comprises a shaft having a plurality of flat blades secured in longitudinally spaced relationship thereon with each of said blades being disposed at an angle selected from the range of from approximately 45° to 75′ relative to a longitudinal and rotational axis of said screw means.

23. The dispenser of claim 22 wherein at least a majority of said blades extend circumferentially approximately 180° about said shaft and further comprising a generally triangularly shaped web interconnected between opposed edges of each adjacent pair of said blades.

24. The dispenser of claim 22 wherein said shaft and said blades comprise a one-piece molded structure.

25. The dispenser of claim 22 wherein said shaft has opposite ends thereof rotatably mounted between one of said side walls and said assembly.

26. The dispenser of claim 25 further comprising means for mounting at least one end of said shaft on said container for permitting said shaft and screw means to move vertically relative to said container.

27. A sanitary foodstuff dispenser for dispensing a measured quantity of solid foodstuff comprising a closed container defining a chamber adapted to be at least partially filled with a preselected quantity of solid foodstuff, a measuring cup means mounted on said container for receiving said measured quantity of said foodstuff screw means exposed to the foodstuff in said chamber for selectively filling said cup means with said measured quantity of foodstuff in response to rotation of said screw means, said screw means comprising a shaft having a plurality of flat blades secured in longitudinally spaced relationship thereon with each of said blades being disposed at an angle selected from the range of from approximately 45° to 75° relative to a longitudinal and rotational axis of said screw means and wherein at least a majority of said blades extend circumferentially approximately 180° about said shaft and further comprising a generally triangularly shaped web interconnected between opposed edges of each adjacent pair of said blades, and dispensing means for dispensing said measured quantity of foodstuff from said cup means.

* * * * *